US006586864B2

(12) United States Patent
Zhou et al.

(10) Patent No.: US 6,586,864 B2
(45) Date of Patent: Jul. 1, 2003

(54) REFLECTOR LAMP HAVING A REFLECTING SECTION WITH FACETED SURFACES

(75) Inventors: Yutao Zhou, Richmond Heights, OH (US); Denis A. Lynch, Jr., South Euclid, OH (US); Tianji Zhao, Mayfield Heights, OH (US); Thomas M. Golz, Willoughby Hills, OH (US); Rolf S. Bergman, Cleveland Heights, OH (US); Frank E. Zalar, Willoughby Hills, OH (US)

(73) Assignee: General Electric Company, Schenectady, NY (US)

( * ) Notice: Subject to any disclaimer, the term of this patent is extended or adjusted under 35 U.S.C. 154(b) by 43 days.

(21) Appl. No.: 09/862,877

(22) Filed: May 22, 2001

(65) Prior Publication Data

US 2002/0011767 A1 Jan. 31, 2002

Related U.S. Application Data

(63) Continuation-in-part of application No. 09/082,922, filed on May 21, 1998, now Pat. No. 6,252,338.

(51) Int. Cl.[7] ..... H01J 5/16; H01J 61/40; H01K 1/26; H01K 1/30

(52) U.S. Cl. ..... 313/113; 313/110; 313/114; 313/315; 313/493; 313/569; 362/328; 362/297; 362/346; 362/348; 362/255

(58) Field of Search ..... 313/113, 110, 313/634, 493, 573, 114, 315, 569; 362/328, 297, 346, 348, 255, 217, 350, 340, 630

(56) References Cited

U.S. PATENT DOCUMENTS

| | | | | |
|---|---|---|---|---|
| 4,021,659 A | | 5/1977 | Wiley | |
| 4,447,865 A | | 5/1984 | VanHorn et al. | |
| 4,494,176 A | * | 1/1985 | Sands et al. | 362/297 |
| 4,855,886 A | | 8/1989 | Eijkelenboom et al. | |
| 5,394,317 A | | 2/1995 | Grenga et al. | |
| 5,488,550 A | | 1/1996 | Yang | |
| 5,568,967 A | | 10/1996 | Sikkens et al. | |
| 5,757,113 A | | 5/1998 | Binder et al. | |
| 5,789,847 A | * | 8/1998 | Woodward et al. | 313/113 |
| 5,800,051 A | | 9/1998 | Gampe et al. | |
| 6,086,227 A | | 7/2000 | O'Connell et al. | |

* cited by examiner

*Primary Examiner*—David Martin
*Assistant Examiner*—Thanh Y. Tran
(74) *Attorney, Agent, or Firm*—Pearne & Gordon LLP

(57) ABSTRACT

The invention is related to a reflector lamp comprising a parabolic primary reflecting section, a parabolic or spheric secondary reflecting section joined to the primary reflecting section, a parabolic or spheric tertiary reflecting section joined to the secondary reflecting section, and an incandescent or discharge light source. The secondary and tertiary reflecting sections have faceted surfaces which longitudinally extend along the surface thereof so that most (at least 50%) or substantially all the light reflected by the faceted surfaces avoids the light source and thus the light, which would be absorbed or scattered by the light source, is minimized or substantially eliminated.

20 Claims, 4 Drawing Sheets

REFLECTOR LAMP HAVING A REFLECTING SECTION WITH FACETED SURFACES

CROSS-REFERENCE TO RELATED APPLICATIONS

This application is a continuation-in-part of U.S. patent application Ser. No. 09/082,922 filed May 21, 1998 now U.S. Pat. No. 6,252,338.

FIELD OF THE INVENTION

This invention relates to a reflector lamp having a reflecting section with faceted surfaces. More particularly, this invention relates to such a reflector lamp which provides improved luminous efficiency by virtue of such faceted surfaces.

BACKGROUND OF THE INVENTION

Known types of reflector lamps, such as floodlights, automotive headlamps and spotlights, comprise a concave reflector and a light source. The light source is recessed in the concave reflector which reflects frontwardly more than half of the total light output of the lamp. Well-designed reflector lamps for display applications such as PAR 20, PAR 30 and PAR 38 lamp types, provide a visually uniform spot of light of a specified angular width. The luminous efficiency of this cone of light (beam) is an important parameter. Lamp makers are making great efforts in order to achieve even a slight further increase in luminous efficiency. The quantity of light in the beam can be increased by deeply recessing the light source in the reflector while at the same time making the light source as small as possible, or for a fixed source size keeping the reflecting surface as far away from the source as possible.

As disclosed in U.S. Pat. No. 4,447,865 issued to Van Horn, Putz and Henderson, Jr. on May 8, 1984, an improved luminous efficiency and a beam pattern substantially circumferentially uniform about the lamp axis and a reasonably compact reflector lamp can be achieved by a concave reflector having a faceted parabolic front section, a spherical intermediate section and a parabolic rear section. Each section has substantially the same common focal point, and a filament light source is located transversally to the lamp axis at the substantially common focal point. The reflector sections are dimensioned so that substantially all light rays coming from the filament light source which are reflected by the spherical intermediate section become reflected by the faceted parabolic front section. The spherical intermediate section allows more of the light rays that are emanated by a long light source which otherwise would not initially strike the parabolic front section to be directed so as to become re-reflected by the parabolic front section. Additionally the light rays, reflected by the facets, include components thereof which are circumferential about the lamp axis and thereby provide a beam pattern which is substantially circumferentially uniform about the lamp axis.

Tungsten halogen filament tubes, mounted axially in the reflector, have generally replaced incandescent filaments as they provide a larger luminous efficiency and also provide whiter light. Filaments are long and have small diameters. When the halogen filament light tubes are axially positioned in the reflector, the facets make the diameter images appear to be larger and to approach the filament length image.

U.S. Pat. No. 4,494,176 of Sands, Marella and Fink, Jr. issued on Jan. 15, 1985 discloses a reflector lamp which may be of the parabolic aluminized reflector (PAR) type lamp. This prior art reflector lamp has a reduced amount of internal absorption and the internal reflective surfaces direct the light rays into the useful beam pattern more advantageously. Instead of the facets on the parabolic front section, the enhanced light output is achieved by subdividing the intermediate section disclosed in U.S. Pat. No. 4,447,865 into further intermediate sections.

This prior art type reflector lamp comprises a concave reflector and a finite light source positioned axially in the reflector. The geometric center of the light source is located approximately at the focal point of the concave reflector. The concave reflector comprises a parabolic reflective section and at least first and second additional parabolic sections. The first and the second additional parabolic sections are reflective and have a substantially common focal point confocal with the focal point of the concave reflector.

The prior art type reflector lamp comprises a further technical improvement. The subdivided intermediate sections, namely the first and second parabolic sections are aligned relative to the light source positioned approximately at the focal point of the concave reflector, i.e., at the focal point of the main parabolic reflective section. This alignment results in a further improved beam pattern. The first and the second additional sections are so aligned relative to the light source as to be effective to reflect light rays impinging on their surfaces onto the primary parabolic reflective section and thereby direct the light rays in an improved beam pattern. Nevertheless, in the case of elongated and axially positioned light sources, particularly halogen gas filament tubes, most of the light and infrared rays reflected by the intermediate section of the reflector go back to the light source itself which partly absorbs, partly scatters these rays. This phenomenon decreases the light output of the reflector lamp on one hand, and increases the temperature of the light source envelope on the other. The increased heat adversely influences the seal integrity and lumen maintenance of the halogen gas filament tube and brings about a premature darkening of the tube envelope.

Accordingly, an object of the present invention is to provide a reflector lamp, particularly a parabolic aluminized sealed halogen reflector lamp, with increased luminous efficiency. This object can be achieved by reducing or substantially eliminating the light absorbed or scattered by the light source.

SUMMARY OF THE INVENTION

In order to achieve these objects and advantages, our invention provides a reflector lamp comprising a substantially parabolic primary reflecting section, a substantially parabolic or substantially spheric secondary reflecting section joined to the primary reflecting section, and a tertiary (or bottom-side ring) reflecting section joined to the secondary reflecting section. The primary, secondary and tertiary sections form substantially a concave reflector with a a substantially planar, parabolic or spheric rear section joined to the tertiary reflecting section 15. The reflector is provided with an incandescent halogen or discharge light source.

The secondary reflecting section has faceted surfaces longitudinally extending along the surface thereof so that a substantial portion of the light reflected thereby avoids the light source and the light absorbed or scattered by the light source is reduced. The tertiary or bottom-side ring refleting section also has faceted surfaces longitudinally extending along the surface thereof, preferably the same number as in the secondary reflecting section. Preferably, the faceted surfaces in the tertiary reflecting section are in phase with the faceted surfaces in the secondary reflecting section; meaning that the faceted surfaces of both the secondary and tertiary reflecting sections are substantially aligned with one another.

In a preferred embodiment of the reflector lamp, the focal point of the secondary reflecting section is axially aligned relative to the focal point of the primary parabolic reflecting section toward the apex of the parabolic reflecting section so that the secondary reflecting section gives room for the ferrule seals needed to provide hermeticity. Preferably, the focal point of the tertiary reflecting section is confocal with the focal points of the primary and secondary reflecting sections so that the tertiary reflecting section gives room for the ferrule seals needed to provide hermeticity.

In an alternate embodiment of the reflector lamp, the faceted surfaces of the secondary and tertiary reflecting sections are circumferentially alternately declined from and inclined to the tangent of the surface at an angle so that substantially all of the reflected light avoids the light source.

BRIEF DESCRIPTION OF THE DRAWINGS

Our invention will be described in greater detail by means of the embodiments illustrated in the accompanying drawings in which.

DESCRIPTION OF THE PREFERRED EMBODIMENTS

Figure 2:
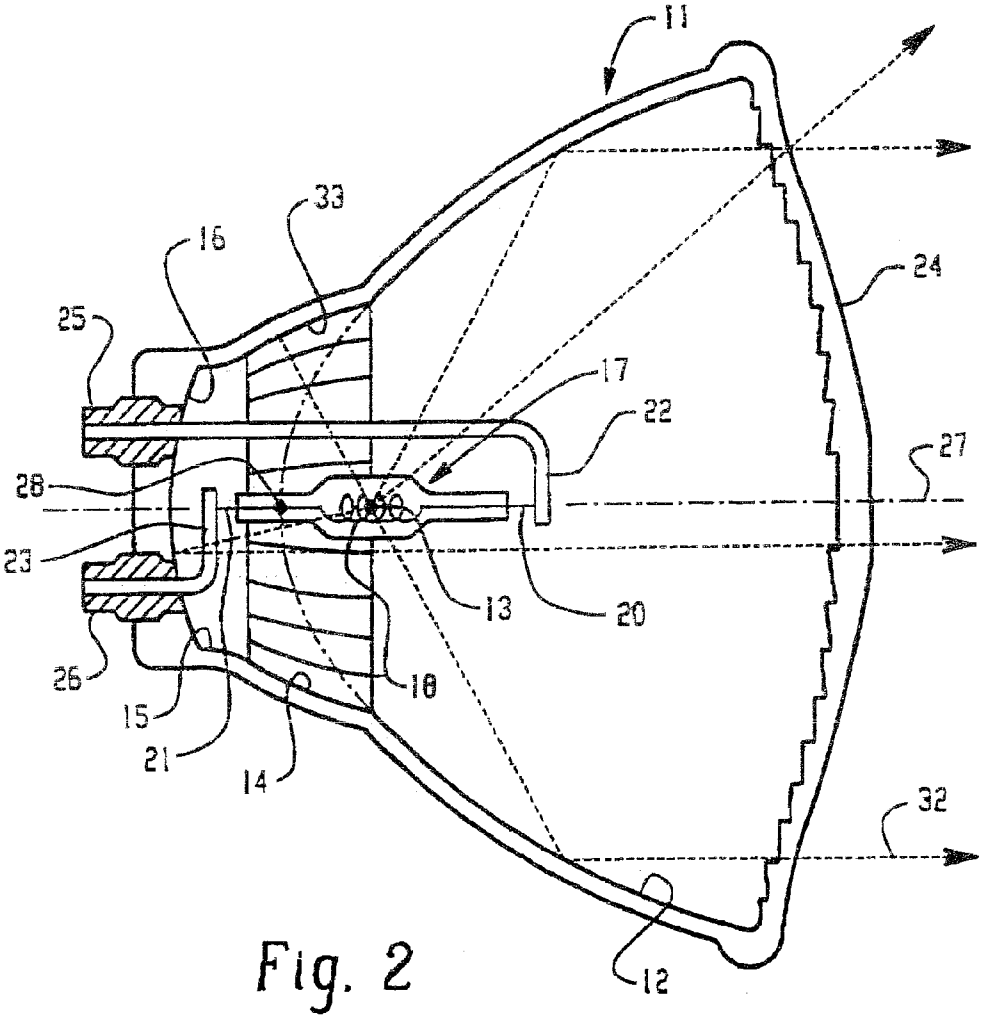
FIG. 2 is a cross section side view taken on the line 2—2 of FIG. 1.

A preferred embodiment of the invention, as shown in the drawings, comprises a reflector lamp having a concave reflector 11 shaped to have a primary reflecting section 12 which has a substantially parabolic contour with focal point 13, a faceted rotated secondary reflecting section 14 which has a substantially spheric or parabolic contour (preferably spheric) with respect to the focal point 13, a tertiary reflecting section 15, and a rear section 16 which may have a substantially planar, spheric or parabolic contour. The cross section of the rotated secondary reflecting section 14 in planes perpendicular to the principal optical axis thereof is substantially circular. The reflector 11 can be made of molded glass, the inner surfaces of the primary reflecting section 12, the secondary reflecting section 14, the tertiary reflecting section 15 and the rear section 16 being coated with reflective material, preferably with aluminum or silver.

A light source 17 centered approximately at the focal point 13, may be an incandescent, a halogen source or a discharge source. In the preferred embodiment of the invention, a halogen incandescent light source is shown.

As shown in FIG. 2, a filament 18 which is preferably made of tungsten is provided with a pair of lead-out wires 20 and 21 of suitable material such as molybdenum. The filament 18 and the lead-out wires 20 and 21 are hermetically sealed in a halogen gas filled glass tube 19. The light source 17 is mounted on a pair of inner leads 22 and 23 of suitable material such as iron, nickel or nickel alloy. According to a preferred embodiment, the light source 17 is positioned coaxially with the central optical axis of the reflector 11 and centered approximately at the focal point 13 thereof, nevertheless it may be located elsewhere along the axis.

A lens or cover plate 24 may be placed or sealed over the front opening of the reflector, to protect the reflecting surface and keep it clean, and/or to modify the light pattern.

In the preferred embodiment of the present invention, the reflector 11 and the light source 17 together with the lens 24 are hermetically sealed to prevent metal component parts such as lead-out wires 20, 21 and inner leads 22, 23 from oxidizing. For the sake of providing for hermeticity at the outlet of inner leads 22 and 23, ferrules 25 and 26 are mounted in the molded glass material of the reflector 11 at the rear section 16 thereof.

Although in the preferred embodiment the reflector 11 and the light source 17 are hermetically sealed, non-hermetically sealed embodiments such as adhesive sealed or glued reflector lamps remain within the scope of our invention. Similarly, although in the preferred embodiment the primary reflecting section 12, the rotated secondary reflecting section 14, and the tertiary reflecting section 15 are substantially confocal (i.e. have the same focal point) it is not required that the focal points of the secondary and tertiary reflecting sections 14 are confocal with the focal point 13. It is advantageous if the focal point of the secondary reflecting section 14 is aligned along the central optical axis relative to the focal point 13 of the primary reflecting section towards the apex 28 of the parabolic primary reflecting section. Likewise, it is advantageous if the focal point of tertiary reflecting section 15 is similarly aligned along the central optical axis relative to the focal point 13 toward the apex of the parabolic primary reflecting section. This alignment results in a further improved beam pattern and also provides more room for the axially mounted elongated halogen light source 17 and the component parts needed to provide hermeticity. These component parts are the leadout wires 20 and 21, the inner leads 22 and 23, and the ferrules 25 and 26.

Although in the preferred embodiment the secondary reflecting section 14 is substantially spheric, this section may have a substantially parabolic shape. Also, though the tertiary reflecting section is preferably parabolic, it can less preferably be spheric, less preferably some other known shape.

Light rays which emanate from the light source 17 and which strike the surface of the secondary reflecting section 14, would be reflected, in the absence of faceted surfaces, back to the light source 17 either to increase the heat of the lamp or to be scattered by the light source 17 and lost as useful light. With the addition of faceted surface 33 to the secondary reflecting section 14, a portion of the light rays will be reflected to strike the substantially parabolic primary reflection section 12 and be re-reflected thereby in a generally frontwardly direction and substantially parallel to the lamp axis 27 as indicated by the light ray path 32. By further providing faceted surfaces 34 on the tertiary reflecting section, the incidence of reflected light impacting light source 17 is further reduced, and more reflected light will be directed around light source 17 toward the primary reflecting section 12 to be redirected out of the lamp, thus improving its overall efficiency.

In the case of light sources such as halogen filament tubes, unfaceted secondary and tertiary reflecting sections 14 and 15 would tend to be less effective as the light output of the reflector lamp is reduced by the light rays absorbed and scattered by the light source 17. Furthermore, the heat generated by the absorbed and scattered infrared rays would limit the wattage of this sealed reflector lamp which has relatively poor heat dissipation.

Figure 1:
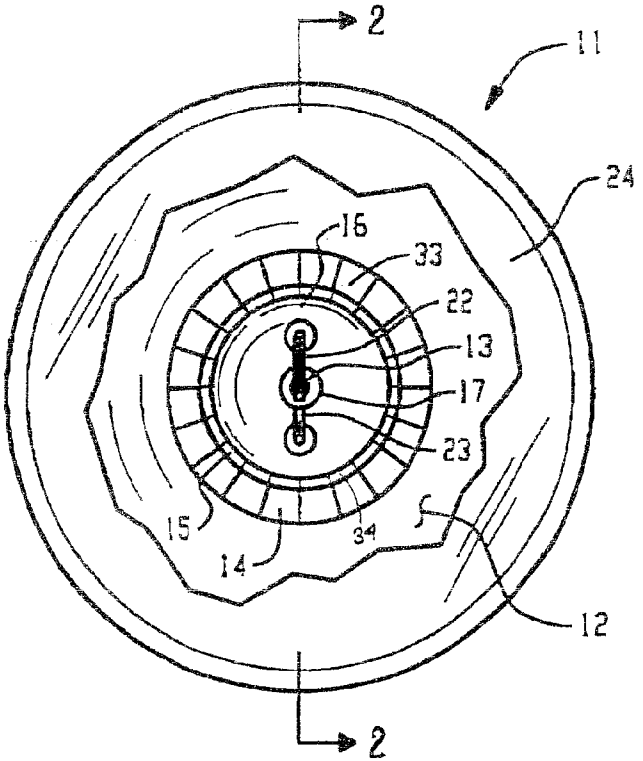
FIG. 1 is a front view of a reflector lamp in accordance with a preferred embodiment of the invention.
Figure 1A:
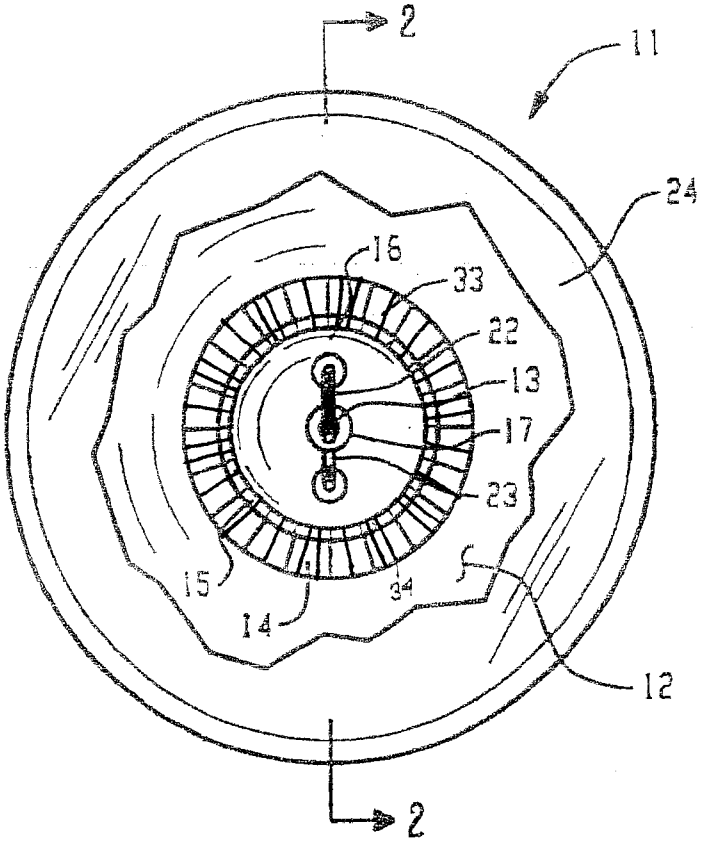
FIG. 1*a* is a front view of a reflector lamp as in FIG. 1, except that the secondary and tertiary reflective sections are shown each having 24 pairs of alternating inclined and declined facets.
Figure 3:
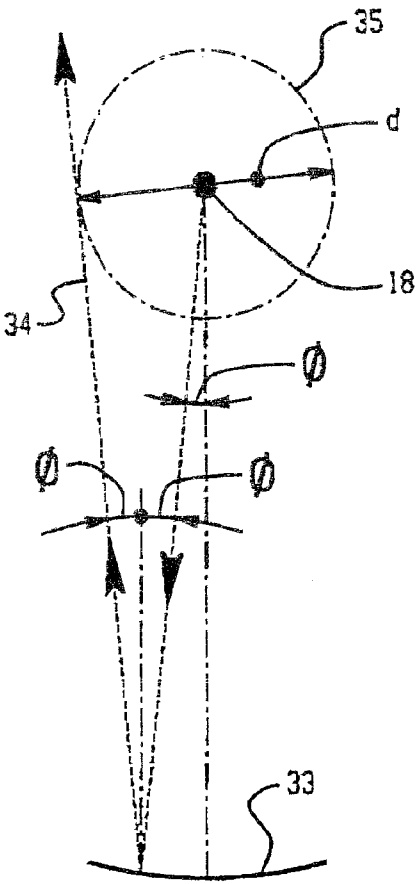
FIG. 3 is a fragmentary schematic cross section view taken on a plane perpendicular to the envelope of the light source in accordance with the preferred embodiment of the invention.

It has been recognized that, in a lamp that does not have a tertiary reflective section, inasmuch as the secondary reflecting section 14 has longitudinally extending faceted surfaces 33 that extend circumferentially about the axis (FIG. 1) along the surface, a portion of the light rays reflected by the secondary reflecting section 14 avoids the light source 17. As shown in FIG. 3, the light ray 34 emanated by the filament 18, practically at the focal point 13, of the light source 17 at an angle $\phi$ with respect to the norm of the faceted surface 33, will be reflected in a direction so as to avoid the envelope 35 of the light source. The angle $\phi$ can be calculated by the equation as follows:

$$\phi = 0.5 \arcsin\frac{d}{D}$$

where d is the diameter of the envelope 35 and D is the diameter of the secondary reflecting section in the plane of reflection. In the case of a preferred form of glass halogen tube $$d=0.452",$$

and
taking into account that $$D=1.84"$$

therefore $$\arcsin\frac{0.452''}{1.84''} = 14.2°, \text{ and}$$

consequently $$\phi=7.1 \text{ degrees.}$$

The maximum number of the faceted surfaces is:

$$\frac{360°}{2\phi} = \frac{360°}{14.2°} = 25.$$

In the case of HIR (halogen infrared reflective) tube $$d=0.3936",$$

therefore $$\arcsin\frac{0.3936''}{1.84''} = 12.4°, \text{ and}$$

consequently $$\phi=6.2°.$$

The maximum number of the faceted surfaces for HIR tube is 29.

The minimum number of the faceted surfaces is a function of the beam pattern desired from the reflector lamp. The estimated practical minimum number ranges from 12 to 16. Too many facets would be difficult to manufacture.

Nevertheless, light rays which strike the faceted surface 33 at an angle smaller than $\phi$ still do not avoid the envelope 35 of the light source.

Figure 4:
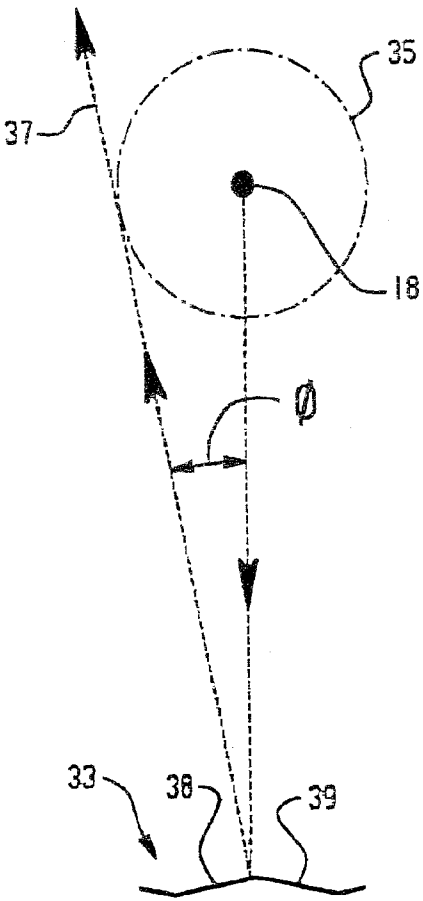
FIG. 4 is a fragmentary schematic cross section front view taken on a plane perpendicular to the envelope of the light source in accordance with an alternate embodiment of the present invention.

In accordance with the most preferred embodiment of the present invention, the light absorbed or scattered by the light source 17 can be substantially eliminated in a PAR 38 lamp. As shown in FIG. 4, the faceted surfaces 33 and 34 are subdivided into faceted surfaces 38 and 39 so that the secondary and tertiary reflecting sections 14 and 15 have faceted surfaces which are circumferentially alternately declined from and inclined to the tangent of the surface of the secondary and tertiary reflecting sections 14 and 15 respectively. Cross-sectionally, a saw-tooth-form surface is created in both secondary and tertiary reflecting sections and the light ray 37, which in the absence of the saw-tooth-form faceted surface would strike the smoothly faceted surface 33 or 34 perpendicularly and which would be in the worst position to miss the light source 17, now avoids the light source 17. Faceted surfaces 38 and 39 are turned with the angle $\phi$ with respect to faceted surface 33 or 34 so that substantially all the light reflected by the secondary and tertiary reflecting sections 14 and 15 avoids the light source 17.

Figure 6:
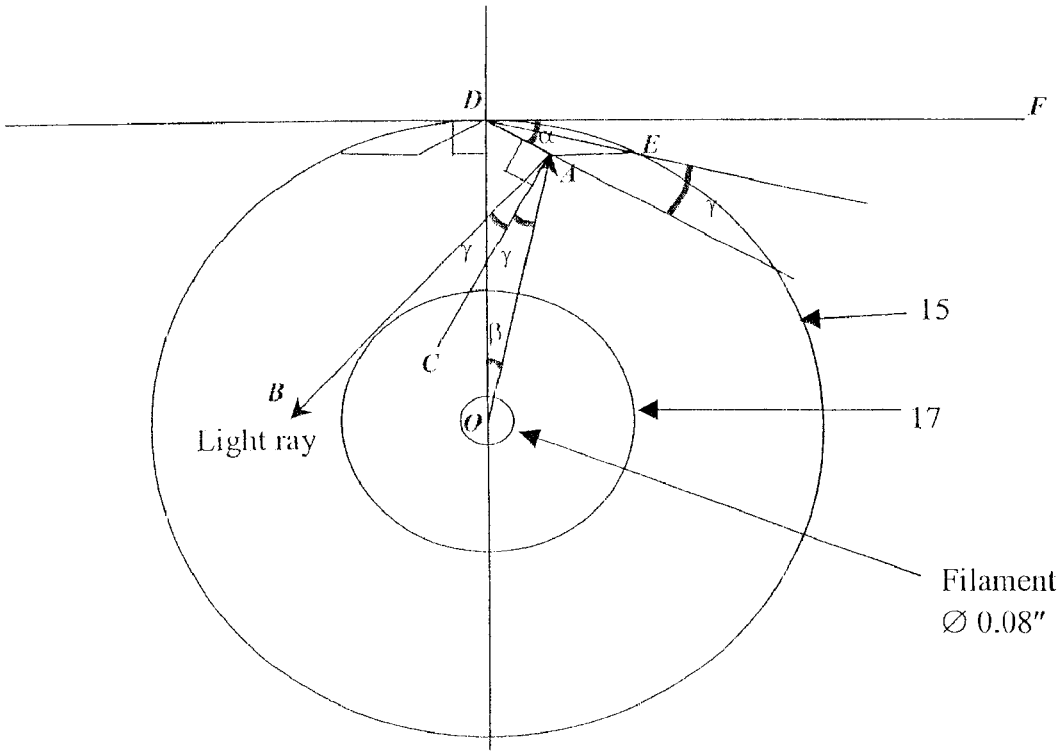
FIG. 6 is a plan schematic view of a PAR 38 lamp (a parabolized aluminum reflector lamp having a nominal lamp diameter of 4.5 inches) showing the tertiary reflecting section, the light source and the filament, and including geometric references used to calculate an optimal number of facets for a PAR 38 lamp in accordance with the present invention.

Referring to FIG. 6, a partial schematic view of a PAR 38 lamp is provided, showing the tertiary reflecting section 15, the light source 17, and the lamp filament. In FIG. 6, DAE is a pair of facets on the base ring of PAR 38 with DA being the surface of one facet and EA the surface of the other. Initially assuming the diameter of the filament is 0, the segment OA represents a typical light ray incident upon the facet from the filament at O, and AB represents the reflected light from incident light OA. DF is perpendicular to OD, and CA is perpendicular to DA. Therefore, if $\angle ADF=\alpha$, $\angle DOA=\beta$, and $\angle ADE=\gamma$, then $\gamma=\alpha-\beta$, and $\angle OAC=\angle CAB=\angle ADE=\gamma$. $\gamma$ determines how tilted each facet should be, and $\beta$ determines the number of facets for this geometry (that of a PAR 38 lamp in this case).

In a PAR 38 lamp, the diameter of light source 17 is typically about 0.46 inches. In order for reflected light AB to avoid light source 17:

$$2\gamma > \arcsin\left(\frac{\text{Radius of wirelamp}}{\text{Radius of base ring}}\right) = \arcsin\left(\frac{0.23''}{0.55''}\right) \approx 25°,$$

so $2\gamma>25°$. Now taking into account the true diameter of the filament, typically 0.08 inches in a PAR 38, the expression becomes:

$$2\left[\gamma - \arcsin\left(\frac{\text{Radius of filament}}{\text{Radius of base ring}}\right)\right] + \arcsin\left(\frac{\text{Radius of filament}}{\text{Radius of base ring}}\right) > 25°$$

and $2[\gamma-4.2°]+4.2°>25°$, so $\gamma>14.6°$. Taking the smallest integer, $\gamma=15°$.

Figure 7:
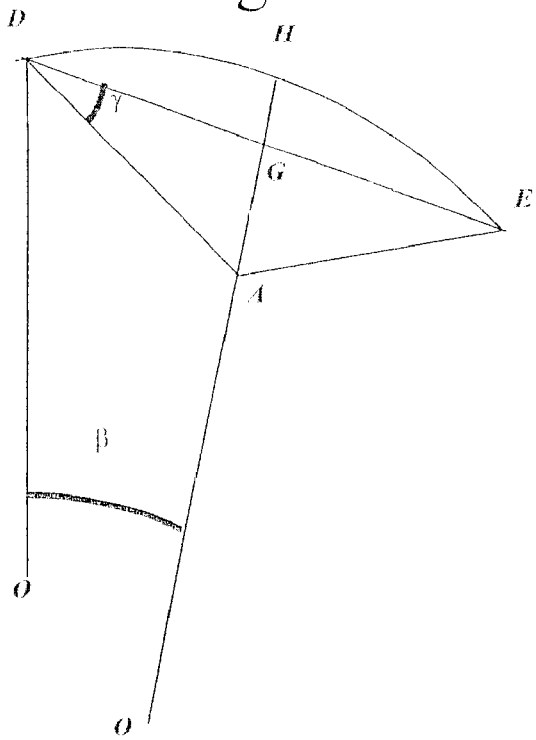
FIG. 7 is a close-up view of section DAE as shown in FIG. 6.

The length of OD=the length of OH=the radius of tertiary reflecting section 15 which is 0.55 inches. As best seen in FIG. 7, the length of AH is the variation of glass thickness due to the existence of tilted facets. The minimum glass thickness is about 0.12 inches, and the glass thickness variation is preferably no greater than 25%. Therefore, $AH \leqq 0.12'' \times 25\% = 0.03$ inches, and:

$$\begin{aligned} AH &= AG + GH \\ &= DG \times \tan(\gamma) + (OH - OG) \\ &= OD \times \sin(\beta) \times \tan(\gamma) + [OH - OH \times \cos(\beta)] \\ &= 0.55 \text{ inches} \times \sin(\beta) \times \tan(15°) + [0.55 \text{ inches} - 0.55'' \times \cos(\beta)]. \end{aligned}$$

Because $AH \leqq 0.03$ inches, the above expression must be less than or equal to 0.03 inches, and $\beta \leqq 9°$. Preferably, the number of alternating inclined/declined facets is an even number, and $\beta$ is preferably chosen to equal 7.5°. Therefore, each pair of facets results in $2\beta=15°$, and dividing into 360° for a complete circle, the preferred number of facets for a PAR 38 lamp is 360°/15°=24 pairs of alternately inclined and declined faceted surfaces 38 and 39. Less preferably, a PAR 38 lamp can have 22–26, less preferably 20–28, less preferably 18–30, less preferably 16–32, pairs of alternately inclined and declined faceted surfaces 38 and 39. A PAR 38 lamp having faceted surfaces 38 and 39 as above described causes more than 50, preferably 60, 70, 80, or 90, percent of the light reflected by the faceted surfaces to avoid the light source 17.

Figure 5:
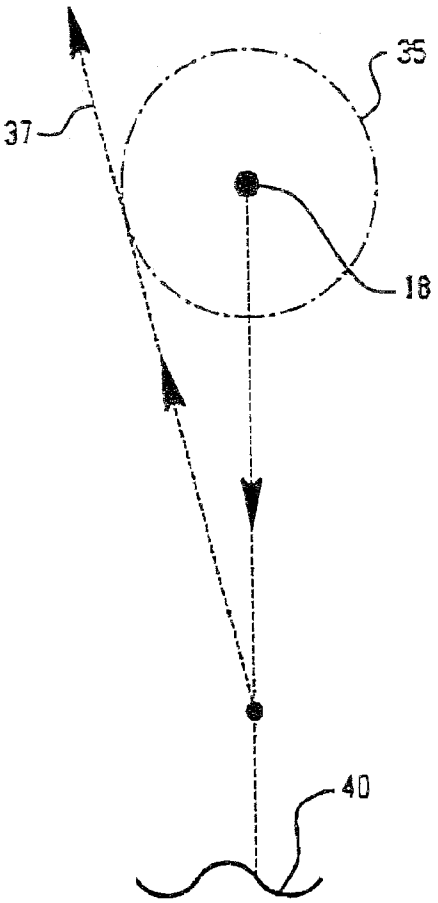
FIG. 5 is a fragmentary schematic cross section front view taken on a plane perpendicular to the envelope of the light source in accordance with yet another alternate embodiment of the present invention.

Although in this preferred embodiment for a PAR 38 lamp the subdivided faceted surfaces 38 and 39 define a cross-sectionally saw-tooth-form surface, it remains still within the scope of our invention if the faceted surfaces form a substantially sinusoidal cross-section. This is illustrated in FIG. 5 where the faceted surface is a substantially sinusoidal cross-section 40. Again, light emanating from the light source, which was typically absorbed or scattered in prior arrangements, is now substantially eliminated by the alternating portions of the sinusoidal cross-section. In this embodiment, a substantial portion of the light reflected from the sinusoidal cross-section of the secondary reflecting section avoids the light source 17.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A reflector lamp comprising:

a substantially parabolic primary reflecting section;

a secondary reflecting section having a contour distinct from said primary reflecting section joined to said primary reflecting section;

a tertiary reflecting section having a contour distinct from said secondary reflecting section and joined to said secondary reflecting section opposite said primary reflecting section; and a light source contained within said primary and secondary sections;

wherein said primary, secondary and tertiary reflecting sections form a substantially concave reflector having a rear section joined to said tertiary reflecting section;

said primary, secondary, tertiary, and rear sections being coated with a reflective material;

each of said secondary and tertiary reflecting sections having faceted surfaces longitudinally extending along the surface thereof, and being positioned to redirect a substantial portion of the light reflected thereby to avoid said light source so that the light absorbed or scattered by said light source is reduced.

2. A lamp according to claim 1, wherein each of said secondary and tertiary reflecting sections has 24 pairs of alternating inclined and declined faceted surfaces, each set of 24 pairs of faceted surfaces forming a saw-tooth pattern in each of said secondary and tertiary reflecting sections when viewed from a longitudinal cross-section thereof.

3. A lamp according to claim 2, wherein the faceted surfaces of said tertiary reflecting section are in phase with the faceted surfaces of said secondary reflecting section.

4. A lamp according to claim 1, wherein a focal point of each of said secondary and tertiary reflecting sections is axially aligned along an optical axis relative to a focal point of said primary reflecting section.

5. A lamp according to claim 1, wherein said primary, secondary and tertiary reflecting sections are substantially confocal.

6. A lamp according to claim 1, wherein said primary and secondary reflecting sections and said light source are hermetically sealed.

7. A lamp according to claim 1, wherein said light source is a halogen filament light source.

8. A lamp according to claim 1, wherein said lamp is a parabolized aluminum reflector lamp having a nominal lamp diameter of about 4.5 inches.

9. A lamp according to claim 1, wherein said light source is a discharge light source.

10. A lamp according to claim 2, wherein said tertiary reflecting section is substantially parabolic in shape.

11. A lamp according to claim 1, wherein said reflective material is aluminum or silver.

12. A lamp according to claim 1, wherein each of said secondary and tertiary reflecting sections has 22–26 pairs of alternating inclined and declined faceted surfaces.

13. A lamp according to claim 1, wherein each of said secondary and tertiary reflecting sections has 20–28 pairs of alternating inclined and declined faceted surfaces.

14. A lamp according to claim 1, wherein each of said secondary and tertiary reflecting sections has 16–32 pairs of alternating inclined and declined faceted surfaces.

15. A lamp according to claim 2, said light source having a diameter of about 0.46 inches.

16. A lamp according to claim 2, said light source comprising a filament having a diameter of 0.08 inches.

17. A lamp according to claim 2, said tertiary reflecting section having a radius of 0.55 inches.

18. A lamp according to claim 2, said lamp being a parabolized aluminum reflector lamp having a nominal lamp diameter of about 4.5 inches.

19. A lamp according to claim 1, wherein at least 50% of the light reflected by said faceted surfaces avoids said light source.

20. A lamp according to claim 2, wherein at least 70% of the light reflected by said faceted surfaces avoids said light source.

* * * * *